United States Patent [19]

Hayashi et al.

[11] Patent Number: 4,554,811

[45] Date of Patent: Nov. 26, 1985

[54] CRANKPIN ROLLING APPARATUS

[75] Inventors: Takehiko Hayashi, Toyota; Hiroyuki Ikuta, Nagoya; Takanori Ohta, Kariya, all of Japan

[73] Assignee: Toyoda Koki Kabushiki Kaisha, Kariya, Japan

[21] Appl. No.: 520,341

[22] Filed: Aug. 4, 1983

[51] Int. Cl.[4] ..... B21H 7/00

[52] U.S. Cl. ..... 72/110; 29/6; 29/90 R

[58] Field of Search ..... 29/6, 90 R; 72/107, 72/110

[56] References Cited

U.S. PATENT DOCUMENTS

| | | | |
|---|---|---|---|
| 3,735,620 | 5/1973 | Naumann | 72/107 |
| 4,299,017 | 11/1981 | Gottschalk | 72/110 |
| 4,437,328 | 3/1984 | Wittkopp et al. | 72/110 |

FOREIGN PATENT DOCUMENTS

| | | | |
|---|---|---|---|
| 730550 | 4/1980 | U.S.S.R. | 72/110 |

*Primary Examiner*—Leonidas Vlachos
*Assistant Examiner*—Jerry Kearns
*Attorney, Agent, or Firm*—Oblon, Fisher, Spivak, McClelland & Maier

[57] ABSTRACT

A crankpin rolling apparatus is provided wherein plural pairs of upper and lower arms are pivotably carried by respective hinge pins extending in parallel relation with the rotational axis of a workpiece support device. A pair of upper and lower roller holders each rotatably carrying burnishing rollers are respectively mounted on each pair of the upper and lower arms. When the plural pairs of upper and lower arms are closed by respective pressuring actuators, the pair of upper and lower roller holders arrest a corresponding one of crankpins of a crankshaft on the workpiece support means and pressure the burnishing rollers upon fillets formed on the corresponding one of crankpins. The hinge pins are respectively carried by a plurality of rocking members, which are independently pivotable about a support shaft held by a machine frame in parallel relation with the rotational axis of workpiece support device. A drive device incorporated in the workpiece support device rotates the crankshaft supported thereon, during which time pivot movements of the rocking members permit the upper and lower roller holders of each pair of upper and lower arms to rotate following a corresponding one of the crankpins. A position control mechanism is further provided for regulating the upper and lower arms to take respective pivot positions suitable for the loading of the crankshaft onto the workpiece support device.

7 Claims, 7 Drawing Figures

CRANKPIN ROLLING APPARATUS

BACKGROUND OF THE INVENTION

1. Field of the Invention

The present invention relates in general to an apparatus for processing crankpins of a crankshaft with burnishing rollers. More particularly, it relates to such an apparatus for effecting roll finishings upon fillets formed on crankpins of a crankshaft.

2. Description of the Prior Art

It is generally known that fillets formed on crankpins and journals of crankshafts for automotive internal combustion engines are processed by burnishing rollers for an increased strength against fatigue. A known fillet rolling apparatus of this type is provided with a pair of master crankshafts each having the same shape as blank crankshafts to be given roll finishings, as disclosed for example in Japanese Patent Application No. 54-117849 laid open for public inspection. In the known apparatus, plural pairs of roller holders respectively arresting crankpins of a blank crankshaft are moved to trace the rotational loci of associated crankpins of the master crankshafts. Such tracing motion of each pair of the roller holders causes burnishing rollers carried on the roller holders to turn on their respective axes as well as to revolve round a corresponding crankpin of the blank crankshaft, whereby fillets of each crankpins of the blank crankshaft can be given roll finishings.

However, using the master crankshafts, the prior art fillet rolling apparatus is incapable of processing other blank crankshafts than those which have the same shape as the master crankshafts. That is, blank crankshafts which differ from the master crankshafts in crankpin stroke or in respective orientations of crankpins cannot be processed even when the roller holders are replaced with those prepared therefor.

SUMMARY OF THE INVENTION

Accordingly, it is a principal object of the present invention to provide an improved crankpin rolling apparatus which does not use any master crankshaft.

Another object of the present invention is to provide an improved crankpin rolling apparatus capable of being easily adapted for various kinds of crankshafts which differ from one another in crankpin stroke or angular locations of crankpins.

Still another object of the present invention is to provide an improved crankpin rolling apparatus of the character set forth above which is also capable of being easily adapted for various kinds of crankshafts which differ from one another in crankpin pitch.

Briefly, according to the present invention there is provided a crankpin rolling apparatus for effecting roll finishings upon crankpins of a crankshaft. In the apparatus, a workpiece support device is mounted on a frame for rotatably supporting a crankshaft to be processed, and a drive device is incorporated in the workpiece support device for rotating the crankshaft about a fixed rotational axis. Plural pairs of arms are pivotably carried by respective hinge pins extending in parallel relation with the rotational axis of the workpiece support device and are respectively connected with pressuring actuators for independent open and close motions. The hinge pins are supported by a support mechanism mounted on the frame for respectively independent movements in a direction toward and away from the rotational axis of the workpiece support device. A pair of roller holders rotatably carrying burnishing rollers are respectively mounted on each pair of the arms and, when the plural pairs of arms are closed by the pressuring actuators, arrest a corresponding one of crankpins of a crankshaft on the workpiece support device. Accordingly, when the crankshaft on the workpiece support device is rotated by the drive device, the roller supports on each pair of the arms are rotated to follow a corresponding one of the crankpins being arrested thereby and perform roll finishings with the burnishing rollers thereof upon the corresponding one of crankpins.

With this configuration, because the support mechanism permits the hinge pins to move independently of one another and freely in a direction toward and away from the rotational axis of the workpiece support device, the crankpin rolling apparatus can be easily adapted for crankshafts of various kinds which differ from one another not only in crankpin stroke, but also in angular orientations of crankpins.

In another aspect of the present invention, a position control mechanism is provided, which is brought into operation prior to the loading of a crankshaft onto the workpiece support device so as to regulate the arms to take respective positions suitable for such a loading operation. Thus, the loading of the crankshaft onto the workpiece support device can be easily performed, and the use of an automatic crankshaft loading device can be realized.

In a further aspect of the present invention, an additional position control mechanism is further provided, which operates selectively with the first mentioned position control mechanism. In this case, the first mentioned position control mechanism regulates the arms to take respective pivot positions suitable for the loading of a first kind of crankshafts, while the additional position control mechanism regulates the arms to take respective pivot positions suitable for the loading of a second kind of crankshafts. A space adjusting mechanism is further provided, which, when operated, varies spaces between the plural pairs of arms. Accordingly, it is possible for the crankpin rolling apparatus to perform roll finishings selectively upon two kinds of crankshafts which differ from each other not only in crankpin orientations, but also in crankpin pitch.

BRIEF DESCRIPTION OF THE ACCOMPANYING DRAWINGS

Various other objects, features and many of the attendant advantages of the present invention will be readily appreciated as the same becomes better understood by reference to the following detailed description of a preferred embodiment when considered in connection with the accompanying drawings, wherein like reference numerals designate the same or corresponding parts throughout the several views, and in which.

DETAILED DESCRIPTION OF A PREFERRED EMBODIMENT

Figure 1:
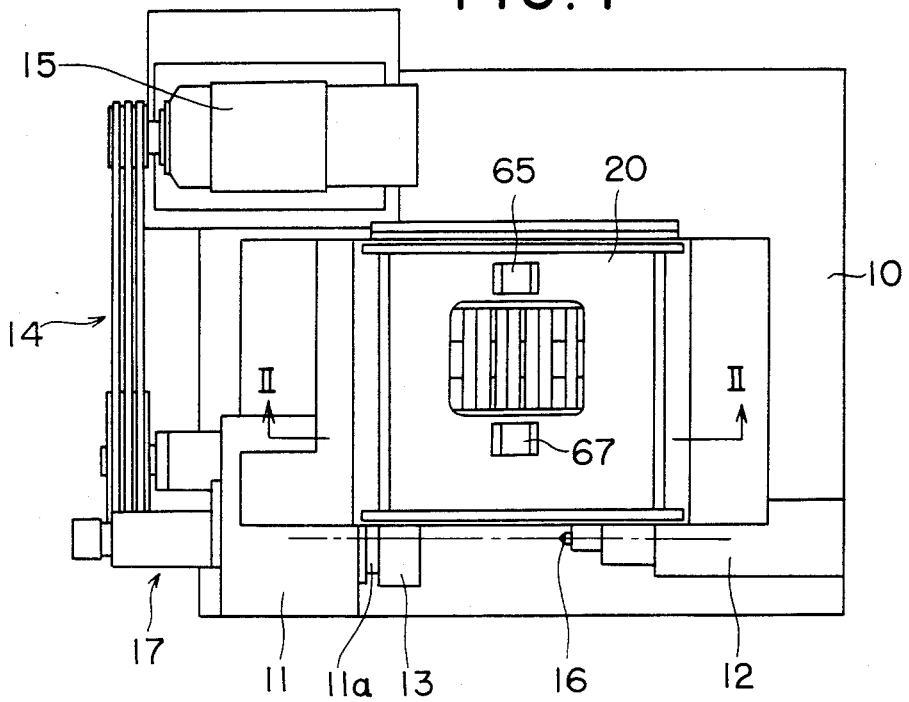
FIG. 1 is a general plan view of a crankpin rolling apparatus according to the present invention.
Figure 2:
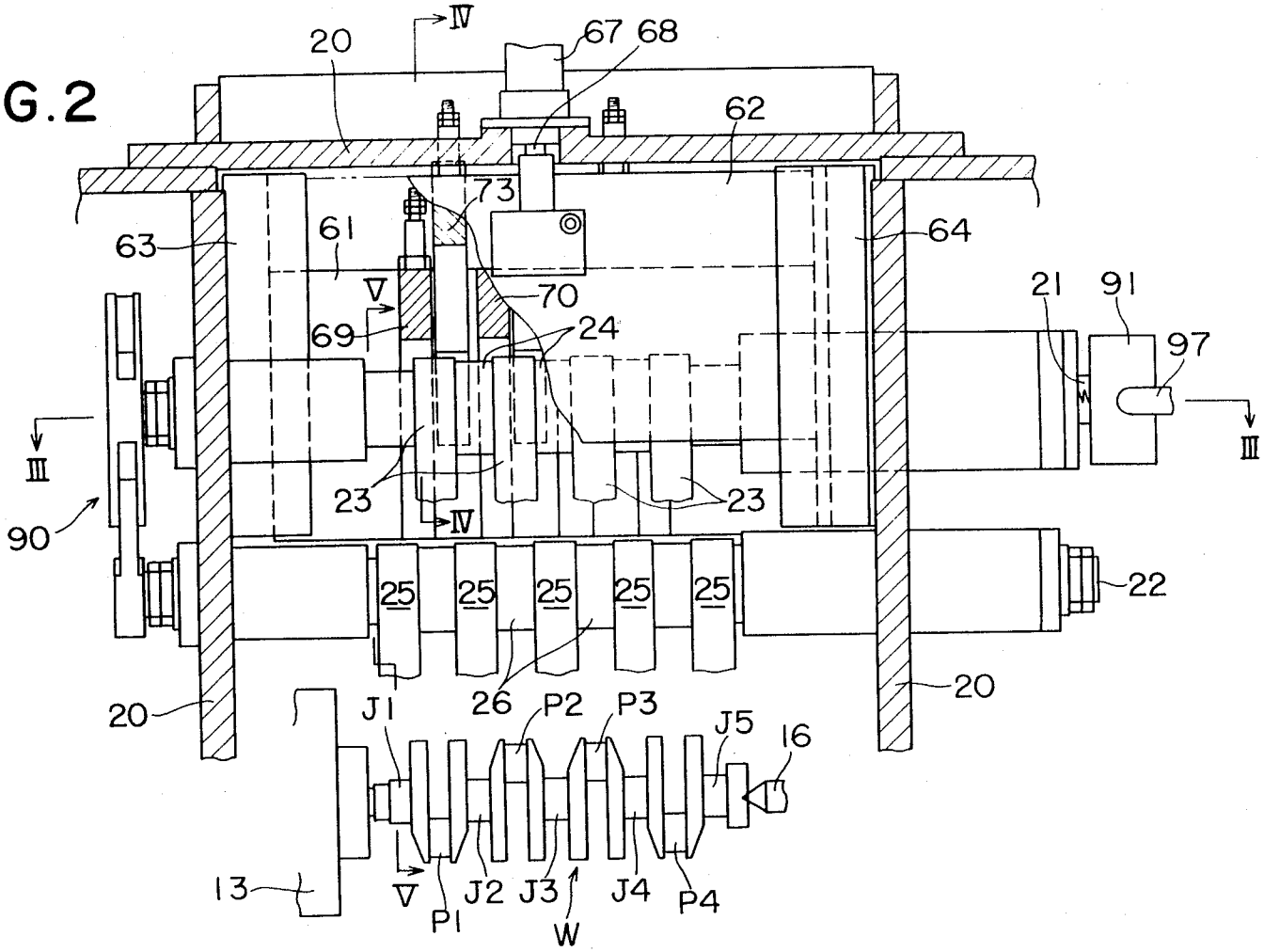
FIG. 2 is a longitudinal sectional view of the apparatus taken along the line II–II in FIG. 1.

Referring now to the drawings and particularly, to FIG. 1 thereof, a crankpin rolling apparatus according to the present invention is illustrated having a base 10, on which a head stock 11 and a tail stock 12 are mounted in a usual manner with a predetermined space. The head stock 11 rotatably carries a work spindle 11*a* having a chuck 13 fixedly mounted at one end thereof. The work spindle 11*a* is in driving connection with a spindle drive motor 15. A workpiece or crankshaft W as shown in FIG. 2 is engaged or arrested by the chuck 13 at its one end and is supported by a center 16 of the tail stock 12 at its other end, so that it can be rotated upon operation of the spindle drive motor 15. The crankpin rolling apparatus includes an indexing device 17 for rotationally indexing the work spindle 11*a* to a predetermined angular position prior to loading and unloading operations of the crankshaft W. The embodiment will be described in greater detail by examples wherein two kinds of crankshafts, i.e., four-cylinder engine crankshafts and three-cylinder engine crankshafts are processed.

Referring now to FIGS. 2 through 5, there is shown a support frame 20 secured to the base 10. The frame 20 rotatably carries a first support shaft 21 in parallel relation with the axis of the work spindle 11*a*. The frame 20 also rotatably carries a second support shaft 22 at a mid position between the axes of the first support shaft 21 and the work spindle 11*a* and in parallel relation with the axes. First rocking members 23 of a number corresponding to crankpins P1–P4 of the largest crankshaft W (e.g., four-cylinder crankshafts) to be processed are carried on the first support shaft 21 at axial positions respectively corresponding to the crankpins P1–P4 for rocking motions. A first space adjuster 24 is interposed between every two of the first rocking members 23, so that the axial spaces of the first rocking members 23 are variable with the change in kind of crankshafts to be processed.

Further, second rocking members 25 of a number corresponding to journals J1–J5 of the largest crankshaft W are pivotably carried on the second support shaft 22 for rocking motions and are spaced for respective radial alignments with the journals J1–J5. A second space adjuster 26 is interposed between every two second rocking members 25, so that the axial spaces between the second rocking members 25 are adjustable with the change from one kind of crankshafts to another kind of crankshafts with a different journal space.

Figure 6:
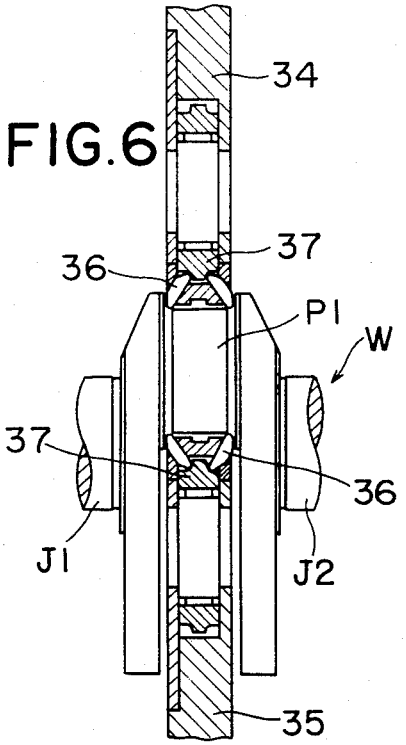
FIG. 6 is a fragmentary sectional view of the apparatus taken along the line VI–VI in FIG. 3.
Figure 4:
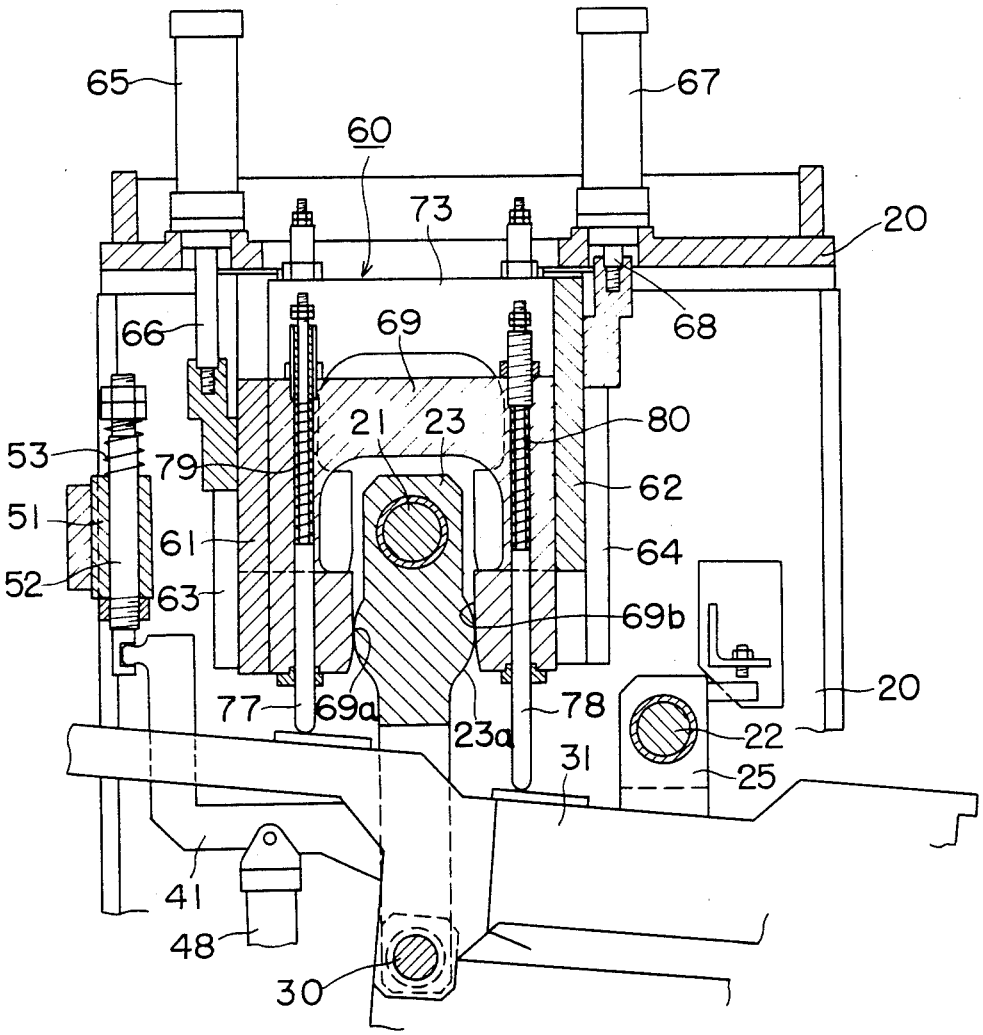
FIG. 4 is a cross section of the apparatus taken along the line IV–IV in FIG. 2.
Figure 5:
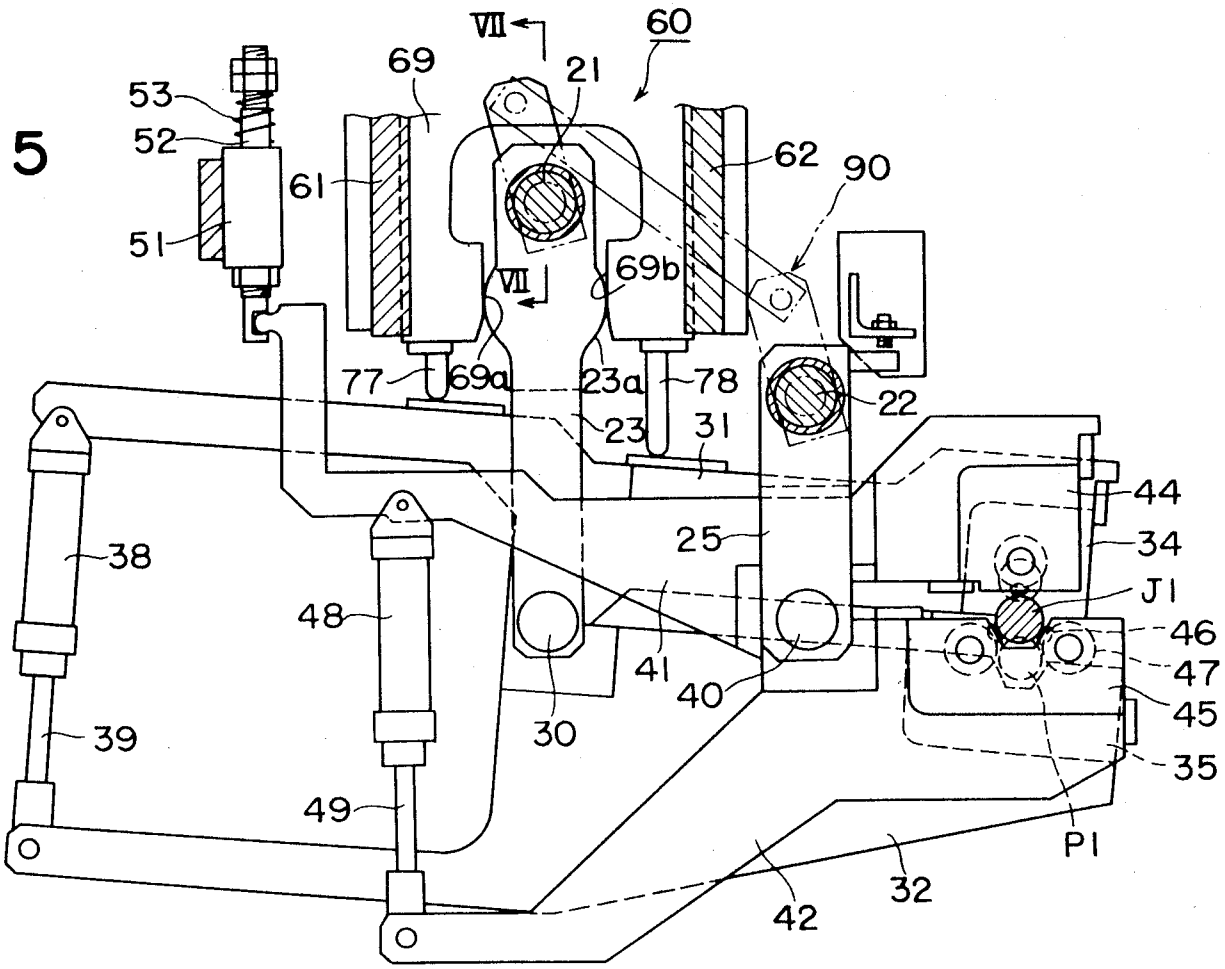
FIG. 5 is a cross section of the apparatus taken along the line V–V in FIG. 2.

As best shown in FIGS. 4 and 5, the first rocking members 23 carried by the first support shaft 21 respectively carry hinge pins 30 in parallel relation with the first support shaft 21. Each of the hinge pins 30 pivotably carries overlapped mid portions of a pair of upper and lower pin arms 31 and 32. The pair of upper and lower pin arms 31 and 32 removably hold at front ends thereof upper and lower roller holders 34 and 35 for holding or arresting a corresponding one of the crankpins P1–P4 from the upper and lower directions, respectively. As can be seen in FIG. 6, the upper and lower roller holders 34 and 35 are provided at equiangular intervals in a circumferential direction of the corresponding crankpin with three roller sets, each of which includes a pair of burnishing rollers 36 being oriented toward fillets formed at axial opposite ends of the corresponding crankpin and a back-up roller 37 for backing up rotations of the burnishing rollers 36. A pressuring cylinder 38 is provided between the rear ends of each pair of the upper and lower pin arms 31 and 32. One end of the pressuring cylinder 38 is pin-connected to the rear end of the upper pin arm 31, whereas a piston rod 39 of the cylinder 38 is pin-connected to the rear end of the lower pin arm 32. Each pair of the upper and lower pin arms 31 and 32 are opened and closed by the operation of the pressuring cylinder 38 associated therewith. To be more exact, each pair of the pin arms 31 and 32 are opened to move their roller holders 34 and 35 away from a corresponding crankpin P1 for loading and unloading of the crankshaft W and are closed to pressure the burnishing rollers 36 of the roller holders 34 and 35 upon the fillets of the corresponding crankpin P1. When the crankshaft W is rotated in a situation that each pair of the roller holders 34 and 35 arrest the corresponding crankpin, the first rocking members 23 are caused to effect rocking motions and this permits each pair of the upper and lower pin arms 31 and 32 to move following rotation of a corresponding crankpin about the journal axis of the crankshaft W.

The second rocking members 25 pivotable about the second support shaft 22 respectively carry at their lower ends hinge pins 40 extending in parallel relation with the second support shaft 22. A pair of upper and lower journal arms 41 and 42 are pivotably carried by each of the hinge pins 40 at overlapped mid portions thereof. A pair of upper and lower roller holders 44 and 45 for holding or arresting one of the crankshaft journals J1–J5 from the upper and lower directions are removably mounted on front ends of each pair of the journal arms 41 and 42, respectively. Three roller sets, each of which includes a pair of burnishing rollers 46 rotatably disposed in position to engage respectively fillets formed at axial opposite ends of each crankshaft journal, are arranged on each pair of the roller holders 44 and 45 at equiangular intervals in a circumferential direction of a corresponding one of the crankshaft journals. Further, a pressuring cylinder 48 is provided between rear ends of each pair of the journal arms 41 and 42. The pressuring cylinder 48 is pin-connected to the rear end of the upper journal arm 41, whereas a piston rod 49 of the cylinder 48 is pin-connected to the rear end of the lower journal arm 42. The journal arms 41 and 42 are selectively opened and closed by the operation of the pressuring cylinder 48 connected thereto. That is, each pair of the arms 41 and 42 are opened to move the roller holders 44 and 45 away from a corresponding one of the journals J1–J5 for loading and unloading of the crankshaft W and are closed to pressure the burnishing rollers 46 of the roller holders 44 and 45 upon the fillets formed on the corresponding one of the journals J1–J5.

Figure 3:
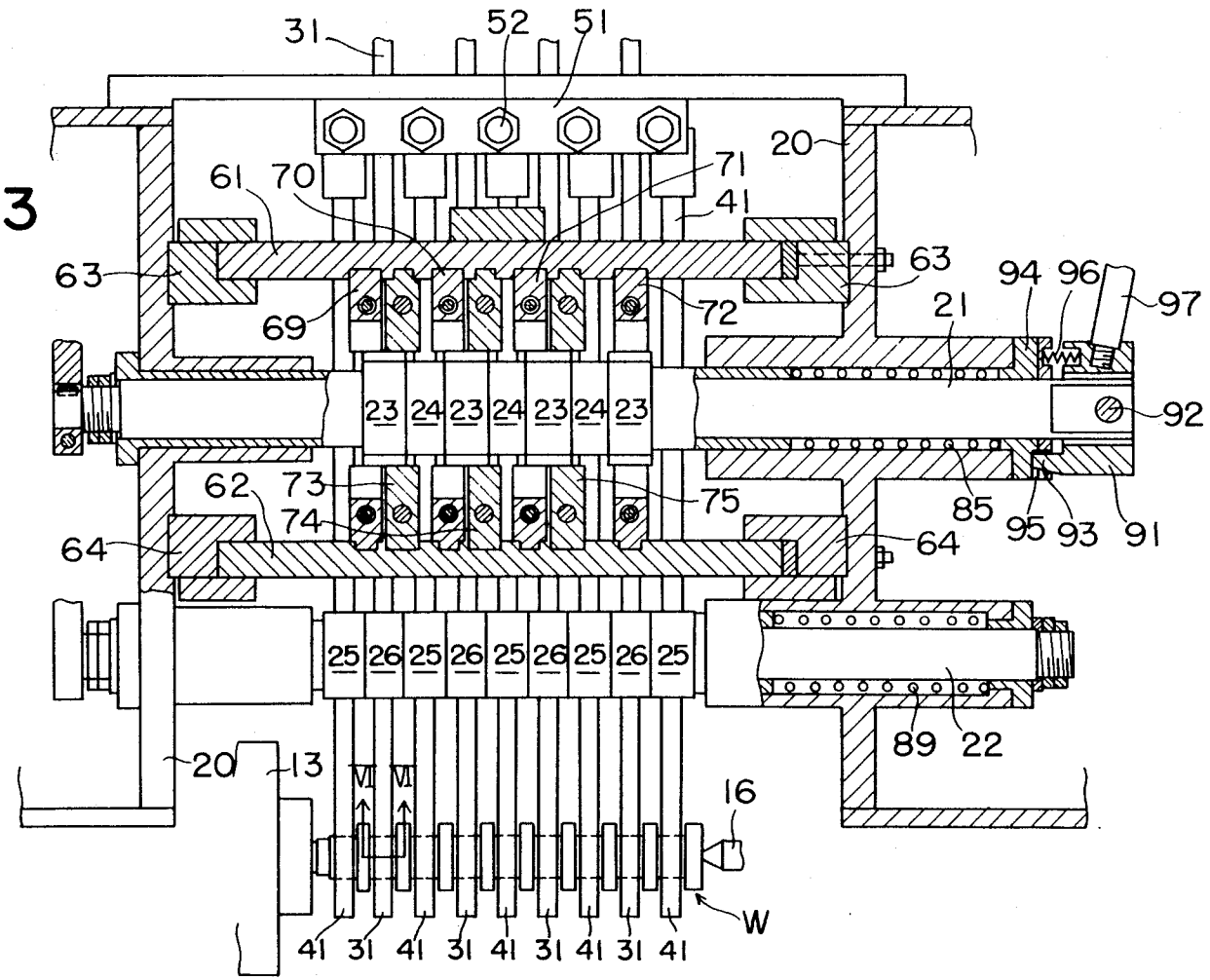
FIG. 3 is a longitudinal sectional view of the apparatus taken along the line III–III in FIG. 2.

As best shown in FIGS. 3 and 4, the rear end of each upper journal arm 41 is engaged with the lower end of a corresponding one of positioning rods 52, which are vertically guided by a guide block 51 secured to the support frame 20. Each of the positioning rods 52 is urged by means of a spring 53 to be held normally at its upper end position. However, each of the positioning rods 52 is lowered against the spring 53 when the setting-up of the crankshaft W on the head stock 11 and the tail stock 12 causes a corresponding one of the upper journal arms 41 to pivot about the hinge pin 40 in a counterclockwise direction as viewed in FIG. 5. Consequently, during a fillet rolling operation, each positioning rod 52 is vertically moved to absorb a misalignment of the corresponding journal from the axis of the work spindle 11*a*.

Description will be made hereafter with respect to position control mechanisms 60 each for regulating four or three pairs of the above-noted upper and lower pin arms 31 and 32 to take respective pivot positions suitable for the loading of the four-cylinder crankshaft W or a three-cylinder crankshaft, not shown. As shown in FIGS. 3 and 4, the support frame 20 vertically carries first and second parallel sliding plates 61 and 62 at diametrically opposite sides of the first support shaft 21. These sliding plates 61 and 62 are vertically slidably guided at their opposite ends by respective pairs of guide blocks 63 and 64 fixedly mounted on the support frame 20. The first sliding plate 61 is connected to a piston rod 66 of an elevation cylinder 65 secured to the support frame 20, while the second sliding plate 62 is connected to a piston rod 68 of an elevation cylinder 67 secured to the support frame 20. A plurality or seven (i.e., the number of crankpins on the four-cylinder crankshaft W plus the number of crankpins on the three-cylinder crankshaft) of position control members 69–75 are provided between the sliding plates 61 and 62 in such a manner as to bestride the first support shaft 21. Each of the position control members 69–75 is formed with two substantially vertical engaging surfaces 69*a* ang 69*b*, which are respectively engageable with opposite arcuate portions 23*a* formed on a mid portion of each first rocking member 23. Each of the position control members 69–75 vertically slidably carries at its portions sandwiching the corresponding first rocking member 23 a pair of pin plungers 77 and 78, which are engageable with two portions on the top surface of the corresponding upper pin arm 31. The pin plungers 77 and 78 are respectively urged by springs 79 and 80 having the same spring force, toward the lower direction. Compression valves of the springs 79 and 80 are adjusted such that different protrusions of the pin plungers 77 and 78 from the lower surface of the position control member 69 are given to regulate the pivot position of the corresponding upper pin arm 31 as desired.

Two of the position control members 69–75 each having the same configuration as typically described above by the position control member 69 are associated with each of the first rocking members 23 except for the first rocking member 23 disposed furthest to the right as viewed in FIG. 3, with which only the position control member 72 is associated. Every two position control members associated with each first rocking member 23 are disposed to face each other at the middle of the width of each first rocking member 23. One of every two position control members 69, 70, 71 or 72 is secured to the first sliding plate 61 at its one end in a direction transverse to the first support shaft 21 and is slidably engaged with the second sliding plate 62 at its other end. On the other hand, the other of every two position control members 73, 74 or 75 is secured to the second sliding plate 62 at its one end in a direction transverse to the first support shaft 21 and is slidably engaged with the first sliding plate 61 at its other end. The position control members 69–75 are held in position not to restrain motions of the first rocking members 23 and the upper pin arms 31 associated therewith when each of the sliding plates 61 and 62 to which they are selectively secured is at its upper end position. However, when either the sliding plate 61 or 62 is lowered by either the elevation cylinder 65 or 67 depending upon the kind of crankshafts being in process (four-cylinder crankshafts or three-cylinder crankshafts in this particular embodiment), the engaging surfaces 69*a* and 69*b* of the position control members 69–72 or 73–75 hold the first rocking members 23 associated therewith at a vertical position, and respective pairs of the pin plungers 77 and 78 hold the corresponding upper pin arms 31 at pivot positions which respectively correspond to crankpins of a crankshaft W being stopped at a predetermined angular position on the axis of the work spindle 11*a*.

Figure 7:
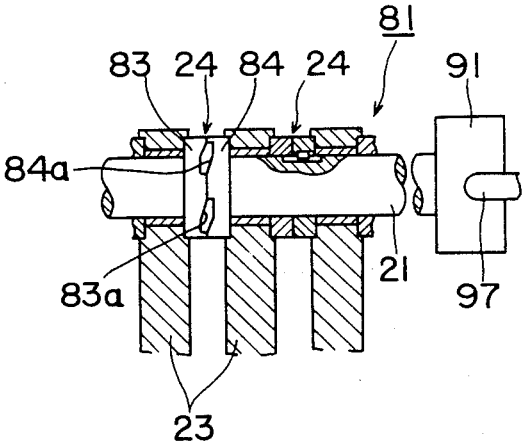
FIG. 7 is a fragmentary sectional view of the apparatus taken along the line VII–VII in FIG. 5.

Description will be made hereafter regarding a space adjusting mechanism 81 for adjusting the spaces between the first rocking members 23 and the space between the second rocking members 25. Referring now to FIGS. 3 and 7, between every two of the plurality (four) of the first rocking members 23 carried on the first support shaft 21, there is provided a space adjuster 24, which is composed of two adjusting rings 83 and 84 being relatively rotatable and in abutting engagement. One of the adjusting rings 84 is axially movably keyed on the first support shaft 21, while the other adjusting ring 83 is secured to the first rocking member 23. The adjusting rings 83 and 84 are formed at their abutting surfaces with complemental serrated cams 83*a* and 84*a*, which are selectively brought into tooth-to-groove engagement and tooth-to-tooth engagement, so that two different spaces can be selectively established between every two first rocking members 23. A spring 85 is provided to bring the first rocking members 23 and the adjusting rings 83 and 84 into abutting engagement with one another, with a freedom for each first rocking member 23 to pivot.

Similarly, a space adjuster 26 is interposed between every two of the plurality (five) of second rocking members 25 carried on the second support shaft 22. The adjuster 26 is composed of two adjusting rings having the same configurations as the aforementioned adjusting rings 83 and 84. A spring 89 is provided to bring the second rocking members 25 and the space adjusters 26 into abutting engagement with one another.

Furthermore, the first and second support shafts 21 and 22 are connected at each one end thereof with each other through a link mechanism 90. This permits rotation given to the first support shaft 21 to be transmitted synchronously to the second support shaft 22. As best shown in FIG. 3, a positioning member 91 is connected by means of a connecting pin 92 to the other end of the first support shaft 21 for pivot movement about an axis perpendicular to the axis of the first support shaft 21. The positioning member 91 is provided with a projection 93, which is selectively engageable with two circumferentially spaced notches 95 formed on an end surface of a fixed bearing 94 rotatably carring the first support shaft 21. Thus, the first support shaft 21 is able to be positioned selectively at the two angular positions. A spring 96 maintains engagement of the projection 93 with a selected one of the notches 95. An operating lever 97 is secured to the positioning member 91 for effecting engagement of the projection 93 into, and disengagement thereof, from the notches 95 as well as rotation of the positioning member 91. When the positioning member 91 is rotated, one of each pair of the adjusting rings 84 keyed on the first and second support shafts 21 and 22 is rotated to be moved axially relative to the other of each pair of the adjusting rings 83 by the action of the serrated cams 83*a* and 84*a*, whereby the space between every two first rocking members 23 and the space between every two second rocking members 25 can be adjusted.

The operation of the apparatus as constructed above will be described hereafter, taking an example of the case wherein a four-cylinder crankshaft W is processed. When roll finishings upon fillets formed on crankpins P1–P4 and journals J1–J5 of a preceding crankshaft W are completed, the crankshaft W being supported between the head stock chuck 13 and the tail stock center 16 is indexed by the indexing device 17 to a predetermined angular position. In this situation, the first sliding plate 61 is lowered by the elevation cylinder 65, and thus, the position control members 69–72 secured to the first sliding plate 61 are bodily lowered. The position control members 69–72, when lowered, cause the opposite engaging surfaces 69*a* and 69*b* thereof to hold the first rocking members 23 associated with the crankpins P1–P4 at a predetermined pivot position, namely at a vertical position. The position control members 69–72, when lowered, further cause the respective pairs of pin plungers 77 and 78 thereof to hold the corresponding upper pin arms 31 at pivot positions respectively corresponding to the crankpins P1–P4 on the crankshaft W.

Subsequently, the pressuring cylinders 38 and 48 are actuated to open the upper and lower pin arms 31 and 32 and to open the upper and lower journal arms 41 and 42. At this time, the lower roller holders 35 respectively holding the crankpins P1–P4 are moved away from the associated upper roller holders 34, and likewise, the lower roller holders 45 respectively holding the journals J1–J5 are moved away from the associated upper roller holders 44. Retraction of the tail stock center 16 and unclamping of the head stock chuck 13 are in turn performed, whereupon the finished crankshaft W is unloaded from the rolling apparatus. It is to be noted that even after the unloading of the workpiece W, the upper and lower pin arms 31 and 32 for the crankpins P1–P4 remain at the pivot positions as regulated respectively by the position control members 69–72.

Thereafter, a crankshaft W to be processed next is loaded between the head stock 11 and the tail stock 12 and is carried and clamped respectively by the tail stock center 16 and the head stock chuck 13. The pressuring cylinders 38 and 48 are then reversely actuated to move the lower pin arms 32 and the lower journal arms 42 respectively towards the upper pin arms 31 and the upper journal arms 41. This causes the burnishing rollers 36 on the roller holders 34 and 35 to be pressured upon the fillets of the crankpins P1–P4 and the burnishing rollers 46 on the roller holders 44 and 45 to be pressured upon the fillets of the journals J1–J5 of the crankshaft W. The first sliding plate 61 is upwardly moved by the elevation cylinder 65 along with the position control members 69–72 secured thereto, whereby the first rocking members 23 and the upper pin arms 31 are released from restraint.

The crankshaft W is then rotated by the drive motor 15, during which time the upper and lower pin arms 31 and 32 now arresting the crankpins P1–P4 and the first rocking members 23 pivotably carrying the pin arms 31 and 32 are moved in obedience to the crankpins P1–P4 being in rotation. Thus, the burnishing rollers 36 being pressured upon the fillets of the crankpins P1–P4 corresponding thereto are rotated about their respective axes while being revolved round the crankpins P1–P4, whereby the fillets of the crankpins P1–P4 are processed by the burnishing rollers 36. Simultaneously, the fillets of the journals J1–J5 are processed by the burnishing rollers 46 being pressured thereupon.

Description will be made hereafter regarding preparatory procedures which should be taken when a three-cylinder crankshaft (not shown) is processed subsequent to the four-cylinder crankshaft W. It is presumed herein that the three-cylinder crankshaft is different from the four-cylinder crankshaft W in the angular locations, the stroke and the axial pitch of crankpins.

First of all, the operating lever 97 is manipulated to rotate the first and second support shafts 21 and 22 a predetermined angular extent. The space adusters 23 and 26 are thus operated, whereby the spaces between the first rocking members 23 and the spaces between the second rocking members 25 are altered to coincide with the axial positions of crankpins and journals of the three-cylinder crankshaft to be processed next. Further, alteration is made so that the pivot positions of the pin arms 31 and 32 for arresting the crankpins are regulated by the position control members 73–75 secured to the second sliding plate 62. This alteration procedure involves raising the first sliding plate 61 by the elevation cylinder 65 and lowering the second sliding plate 62 by the elevation cylinder 67. The position control members 73–75, when lowered, regulate the upper and lower pin arms 31 and 32 to take those pivot positions suitable to three crankpins of the three-cylinder crankshaft being positioned at a predetermined angular position on the axis of the work spindle 11*a*.

In addition, because two pairs of the arms 31, 32, 41 and 42 for the rightmost crankpin P4 and the rightmost journal J5 of the aforementioned four-cylinder crankshaft W are unnecessary in the processing of the three-cylinder crankshaft, they are selectively disabled by being fixedly held by means of suitable fixing tools at pivot positions where they do not obstruct the loading and unloading of the three-cylinder crankshaft and the extension movement of the tail stock center 16. If need be, the roller holders 34, 35, 44 and 45 may be replaced with those prepared for the three-cylinder crankshaft.

Upon completion of the foregoing preparatory procedures, it becomes possible to effect roll finishings upon the crankpins and journals of the three-cylinder crankshaft in the same manner as described earlier in connection with the four-cylinder crankshaft W.

In the above-described embodiment, the preparatory procedures are required to effect roll finishings upon crankshafts of two different kinds. However, such preparatory procedures can be omitted if crankshafts of a new kind differ from those of a previous kind only in crankpin stroke.

Moreover, the crankpin rolling apparatus according to the present invention can be used not only in processing two kinds of crankshafts as exemplified above, but also in processing three or more kinds of crankshafts. It is of course apparent that the space adjusting mechanism 81 for adjusting the spaces between the first rocking members 23 and the spaces between the second rocking members 25 may not be incorporated if all kinds of crankshafts to be processed in the rolling apparatus have the same axial pin-to-pin pitch as one another.

In order to make the unloading of any finished crankshaft easy, the indexing device 17 is provided in the above-described embodiment. However, it should be realized that the indexing device 17 may be excluded since the exclusion of the indexing device 75 does not raise any difficulty in loading of any crankshaft to be processed.

Obviously, numerous modifications and variations are possible in light of the above teachings. It is therefore to be understood that within the scope of the appended claims, the present invention may be practiced otherwise than as specifically described herein.

What is claimed is:

1. A crankpin rolling apparatus comprising in combination:

a frame;

workpiece support means mounted on said frame for rotatably supporting a crankshaft to be processed;

plural pairs of arms spaced at the same intervals as crankpins of said crankshaft in an axial direction of said crankshaft;

a plurality of hinge pins extending in parallel relation with the rotational axis of said workpiece support means and respectively pivotably carrying said plural pairs of arms each for permitting a corresponding one pair of said arms to effect open and close motions;

a plurality of pressuring actuators respectively connected to said plural pairs of arms for independently effecting open and close motions of said plural pairs of arms;

a pair of roller holders fixedly mounted respectively on each pair of said arms and rotatably carrying burnishing rollers, said pair of roller holders being capable of engaging one of said crankpins aligned radially therewith and pressuring said burnishing rollers thereof upon said one of said crankpins when said each pair of arms are closed by a corresponding one of said pressuring actuators;

an arm support mechanism mounted on said frame for independently supporting each of said hinge pins for movement toward and away from the rotational axis of said workpiece support means so that said pair of roller holders engaging a corresponding one of said crankpins are rotated together with said corresponding one of said crankpins when said crankshaft is rotated, said arm support mechanism comprising a support shaft carried on said frame in parallel relation with the rotational axis of said workpiece support means, and a plurality of rocking members pivotably carried on said support shaft and respectively supporting said hinge pins for permitting the same to move independently in a direction toward and away from the rotational axis of said workpiece support means;

drive means for rotating said crankshaft on said workpiece support means about the axis thereof so that said burnishing rollers of said pair of roller holders effect roll finishing upon said corresponding one of said crankpins being engaged by said pair of roller holders;

first position control means mounted on said frame for regulating positions of said hinge pins in a direction toward and away from the rotational axis of said workpiece support means and the pivot positions of said plural pairs of arms about said hinge pins prior to the loading of said crankshaft onto said workpiece support means;

second position control means mounted on said frame and operable selectively with said first position control means for regulating positions of said hinge pins in a direction toward and away from the rotational axis of said workpiece support means and pivot positions of said plural pairs of arms about said hinge pins prior to the loading onto said workpiece support means of another crankshaft which is different from said crankshaft in kind; and means for selectively disabling at least one of said plural pairs of arms such that said at least one pair of arms does not obstruct loading and unloading of said another crankshaft on said workpiece support means.

2. A crankpin rolling apparatus as set forth in claim 1, wherein said first position control means includes;

a plurality of position control members movably guided by said frame and respectively engageable with said rocking members for regulating pivot positions of said rocking members about said support shaft;

a pair of spring-biased plungers provided on each of said position control members and engageable with at least one of said arms pivotably carried by a corresponding one of said rocking members for regulating pivot positions of said arms pivotably carried by said corresponding one of said rocking members; and an actuator connected to said plurality of position control members for moving said position control members to their operative positions to regulate pivot positions of said rocking members and said arms.

3. A crankpin rolling apparatus as set forth in claim 1, wherein;

said burnishing rollers rotataby carried on said pair of roller holders are engageable with fillets formed on said corresponding one of said crankpins.

4. A crankpin rolling apparatus comprising in combination;

a frame;

workpiece support means mounted on said frame for selectively rotatably supporting first and second crankshafts different from each other in kind;

plural pairs of arms spaced in a direction parallel with the rotational axis of said workpiece support means;

a plurality of hinge pins extending in parallel relation with the rotational axis of said workpiece support means and respectively carrying said plural pairs of arms each for permitting a corresponding one pair of said arms to effect open and close motions;

a plurality of pressuring actuators respectively connected to said plural pairs of arms for independently effecting open and close motions of said plural pairs of arms;

a pair of roller holders fixedly mounted respectively on each pair of said arms and rotatably carrying burnishing rollers, said pair of roller holders being capable of engaging one of said crankpins aligned radially therewith and pressuring said burnishing rollers thereof upon said one of said crankpins when said each pair of arms are closed by a corresponding one of said pressuring actuators;

an arm support mechanism mounted on said frame for independently supporting each of said hinge pins for movement toward and away from the rotational axis of said workpiece support means;

a space adjusting mechanism incorporated in said arm support mechanism for adjusting spaces between said plural pairs of arms in correspondence to the crankpin pitch of one of said first and second crankshafts;

drive means for rotating one of said first and second crankshafts on said workpiece support means about the axis thereof so that said burnishing rollers of said pair of roller holders effect roll finishings upon said one of said crankpins being engaged by said pair of roller holders;

first and second position control means mounted on said frame and selectively operable each for regulating positions of said hinge pins in a direction toward and away from the rotational axis of said workpiece support means and the pivot positions of said plural pairs of arms about said hinge pins prior to the loading of a corresponding one of said first and second crankshafts onto said workpiece support means; and means for selectively disabling at least one of said plural pairs of arms such that said at least one of said plural pairs of arms does not obstruct loading and unloading of one of said crankshafts on said workpiece support means.

5. A crankpin rolling apparatus as set forth in claim 4, wherein said arm support mechanism includes;

a support shaft carried on said frame in parallel relation with the rotational axis of said workpiece support means; and a plurality of rocking members pivotably carried on said support shaft and respectively supporting said hinge pins for permitting the same to move independently in a direction toward and away from the rotational axis of said workpiece support means.

6. A crankpin rolling apparatus as set forth in claim 5, wherein said support shaft is rotatable between first and second angular positions, and wherein said space adjusting mechanism includes:

a pair of adjusting rings interposed between every two of said rocking members and carried on said support shaft, one of each said pair of adjusting rings being secured to said support shaft and including means for varying the axial space thereof relative to the other of said adjusting rings so as to vary the space between a corresponding two of said rocking members in an axial direction of said support shaft when said support shaft is rotated from one of said first and second angular positions to the other angular position; and means connected to said support shaft for maintaining said support shaft at a selected one of said first and second angular positions.

7. A crankpin rolling apparatus as set forth in claim 6, wherein each of said first and second position control means includes:

a plurality of position control members movably guided by said frame and respectively engageable with said rocking members for regulating pivot positions of said rocking members about said support shaft:

a pair of spring-biased plungers provided on each of said position control members and engageable with at least one of said arms pivotably carried by a corresponding one of said rocking members for regulating the pivot position of said at least one of said arms for the loading of a corresponding one of said first and second crankshafts onto said workpiece support means; and an actuator connected to said plurality of position control members for moving said position control members to their operative positions to regulate pivot positions of said rocking members and said arms.

* * * * *